United States Patent [19]

Schukei et al.

[11] Patent Number: 4,729,869

[45] Date of Patent: Mar. 8, 1988

[54] MODULAR RADIATION SHIELDING SYSTEM

[75] Inventors: Glen E. Schukei, So. Windsor; Francis X. McDonald, Enfield, both of Conn.

[73] Assignee: Combustion Engineering, Inc., Windsor, Conn.

[21] Appl. No.: 892,543

[22] Filed: Aug. 4, 1986

[51] Int. Cl.[4] ..... G21F 3/00

[52] U.S. Cl. ..... 376/287; 250/515.1; 376/288

[58] Field of Search ..... 165/11 A; 250/515.1, 250/517.1; 376/287, 288

[56] References Cited

U.S. PATENT DOCUMENTS

| | | | |
|---|---|---|---|
| Re. 18,349 | 2/1932 | Lapof | 250/517.1 |
| 4,514,640 | 4/1985 | Bagnell et al. | 250/517.1 |

FOREIGN PATENT DOCUMENTS

| | | | |
|---|---|---|---|
| 646040 | 4/1964 | Belgium | 376/287 |
| 2534730 | 4/1984 | France | 250/515.1 |
| 370722 | 4/1939 | Italy | 250/515.1 |

*Primary Examiner*—Deborah L. Kyle
*Assistant Examiner*—Richard W. Wendtland
*Attorney, Agent, or Firm*—John H. Mulholland

[57] ABSTRACT

A modular radiation shielding system for use on the lower side of a nuclear steam generator tubesheet 14 to protect inspection and repair workers in the primary head 20 of the generator 10 from radiation of the tubesheet 14 and plurality of tubes 12 it secures. The modular assemblies each comprise a geometrically shaped lead panel 22 sheathed in a stainless steel box 30 with a transverse opening extending therethrough for alignment with a tube 12. A rapid installation tube gripper 40, which may have a lead nose for shielding, extends through the opening and into a tube 12 to hold the geometrically shaped modular assembly against the lower surface of the tubesheet 14.

6 Claims, 9 Drawing Figures

MODULAR RADIATION SHIELDING SYSTEM

BACKGROUND OF THE INVENTION

1. FIELD OF THE INVENTION

The present invention relates to facilitating the maintenance of nuclear power systems and particularly to minimizing the exposure to radioactivity of service personnel working within the steam generator of a nuclear power system during the performance of routine periodic maintenance thereon. More specifically, this invention is directed to a radiation shielding system employing shielding modules or tiles which may be rapidly and easily installed in steam generators.

2. DESCRIPTION OF THE PRIOR ART

While not limited thereto in its utility, the present inventive system has been designed for use in, and has special utility for, the servicing of the steam generators of nuclear power systems, particularly such systems which employ pressurized water type reactors. Such steam generators comprise a pressure vessel having a lower plenum area which is a hemisphere of five to seven feet radius divided into two halves. A coolant, which has been heated in the reactor, is delivered to one of the plenum halves and is then circulated, via a bundle of tubes, which may contain from 3,000 to 11,000 tubes supported by a horizontal tube sheet, through the steam generator vessel. The coolant is subsequently discharged from the other plenum half and returned to the reactor. During passage through the steam generator tube bundle, heat from the reactor coolant is transferred to water under pressure which subsequently flashes to steam for driving a turbine.

Nuclear Regulatory Commission rules require periodic inspection of the steam generators of nuclear power systems. To this end, the steam generator vessel is provided with access openings, known in the art as "manways", in the lower plenum area. During normal operation these access openings are sealed by means of covers. In order to perform inspections, after the vessel has cooled and the "primary loop" has been drained of reactor coolant, the manway covers are removed.

Once access to the interior of the steam generator pressure vessel is possible, a number of different procedures may have to be performed within the vessel. However, since the interior of the steam generator vessel is classified as a highly radioactive environment, maintenance personnel may work in the lower plenum area for only short periods of time. The types of procedures which may have to be performed from within the lower plenum area of a stem generator vessel include non-destructive testing, steam generator tube pulling, steam generator tube plugging, installation of sleeves in steam generator tubes and the installation of nozzle dams to prevent backflow of coolant from the reactor pressure vessel should it be necessary to flood the reactor in order to perform separate operations thereon.

The non-destructive testing will typically comprise ultrasonic and/or eddy current examination of the interior of a preselected percentage of the steam generator tubes. For example, 3% of the tubes will be tested to determine if there is any reduction in effective wall thickness, i.e., cracks, pits, or corrosion, of greater than 20% or any growth in effective wall thickness, i.e., scaling or other deposits, of more than 20%. If a preselected number of the tested tubes are found to exceed the set limits for increased or reduced wall thickness, an additional percent of the tubes will be tested.

Steps must be taken to minimize the radiation exposure of service personnel who are working under the tube sheet in the lower plenum area. Prior attempts to provide the requisite radiation shielding in the lower plenum area below the tube sheet have largely been limited to hanging lead blankets under the open tube ends and tube sheet on scaffold-like racks. This has not proven to be a satisfactory procedure since the racks and blankets take a long time to install, and the installers are subjected to radiation during the installation.

The recent development of a new "Rapid Installation Tube Gripper" invention has provided a fastening device which made the modular radiation shielding system of the present invention practical. The gripper was invented by Glenn E. Schukei, one of the joint inventors of the instant invention, and Robert J. Schukei, and is the subject of U.S. patent application Ser. No. 686,114, filed Dec. 24, 1984.

The gripper device can be rapidly attached to the inside of a steam generator tube to secure a modular lead shielding tile. The device uses hard balls which are held in position by a sleeve so that the balls can be wedged between a tapered shaft and the wall of the tube when an attempt is made to withdraw the tapered shaft. The harder the shaft is pulled, the tighter the balls are wedged, thus insuring that they cannot be inadvertently withdrawn. To release the device, the tapered shaft is inserted further into the tube than the sleeve, so that the balls are relocated relative to the tapered surface. The released position of the balls and tapered shaft is maintained by the sleeve until the device is removed from the tube.

A single worker is permitted to stay in the lower plenum without shielding for only two or three minutes, during which time he may be exposed to his three month radiation dose limit. From this it can be seen that any system that can save even a few seconds or can shield any significant radiation is quite valuable.

SUMMARY OF THE INVENTION

The present invention overcomes the above-discussed and other deficiencies and disadvantages of the prior art and in so doing comprises a novel modular radiation shielding system for providing extended periods of worker access to a radioactive environment. Specifically, the present invention comprises a novel radiation-shielding modular sheathed lead tile assembly which, through the use of rapid installation tube gripper fastening components, may be employed to allow extended periods of access by service personnel to the radioactive environment in the plenum under the tube sheet and tube bundle it supports.

The tubes' inside surface contribute the major portion of radiation in the primary head or plenum. This area of the steam generator is highly contaminated and frequently has radiation levels of 20 to 30 rem at the tubesheet with perhaps a general field of 10 rem in the head area. As can be seen, a high percentage of the incident radiation comes from the steam generator tubes and tubesheet. This is caused by the large surface area inside tubes which have a thin layer of "crud" that causes radiation to beam down to the head work area. In fact, the contaminated surface of only 6 inches of tube length is nearly 12.5 $in^2$ as opposed to the tube cross section area of slightly less than 0.3 $in^2$. Obviously, the tubes hold a large percentage of available radioactive material. The 1/10 value layer (thickness of material to reduce the radiation by 1/10 for gammas) is about 1 inch of lead. If we could put 1 inch of lead under the tubesheet, we would therefore reduce the radiation contribution from the tubesheet area by a factor of 10 (reduction of from 30 to 3 rem).

This reduction in exposure would increase the amount of time a worker could spend in the head which would result in significant savings in:

1. Exposure (due to the increased amount of time for each worker to remain in the plenum);
2. Manpower (less workers needed for a specific job); and
3. Job efficiency (more time allowed, so workers are not pressured into mistakes, due to hurrying).

The invention, then, is a modular radiation shielding system which consists of lead tiles one inch thick being mounted rigidly under the tubesheet. This is accomplished using a rapid tube gripper which enters and locks itself in a tube with one single shove, therefore decreasing installation time. Each gripper can hold loads in excess of 200 lbs with no slippage, giving the workers below confidence in its integrity. Moreover, it cannot be bumped free or accidentally released but when purposely disengaged will exit the tube quickly and easily.

The individual lead shielding tiles are approximately $7\frac{1}{2}'' \times 8\frac{3}{4}'' \times 1''$ with a transverse gripper hole and weigh approximately 30 lbs. This size and shape can be easily handled by one person and is light enough to be remotely installed. The tile size and weight may vary depending on the particular steam generator and the amount of shielding desired. Each tile is contained in a stainless steel sheath which preserves the tile's geometry and prohibits undesirable lead deposits in the head. The sheath also allows for easy decontamination of the tiles and is compatible with steam generator materials. The tiles are symmetrical about one axis and asymmetrical about a second axis perpendicular thereto, so that if a previously plugged tube is encountered, a quick 180° rotation aligns the gripper hole with another tube.

When the sheathed modular tile is pushed to the tubesheet, the gripper holds it in position. It's release is accomplished by pulling on the projecting handle to release the cams and, thus, the assembly. It is estimated that 6 to 10 assemblies could be installed in one minute by one jumper. This would result in an installation time of about 10 minutes for an entire 8000 tubes. Since nearly 1200 (1/7) of the tubes are in the outer 5 rows which do not significantly contribute to worker exposure due to their location, it is obvious that the radiation level would be greatly reduced before all the tubes are blocked. The installation exposure is, therefore, appreciably less than that which would be received in a field of 30 rem for 10 minutes (5 man rem). The individual sheathed tiles can also be independently removed to allow access to local tubes while still providing area shielding.

BRIEF DESCRIPTION OF THE DRAWING

The present invention may be better understood and it's numerous objects and advantages will become apparent to those skilled in the art by reference to the accompanying drawings wherein like reference numerals refer to like elements in the several figures and in which.

Figure 5:
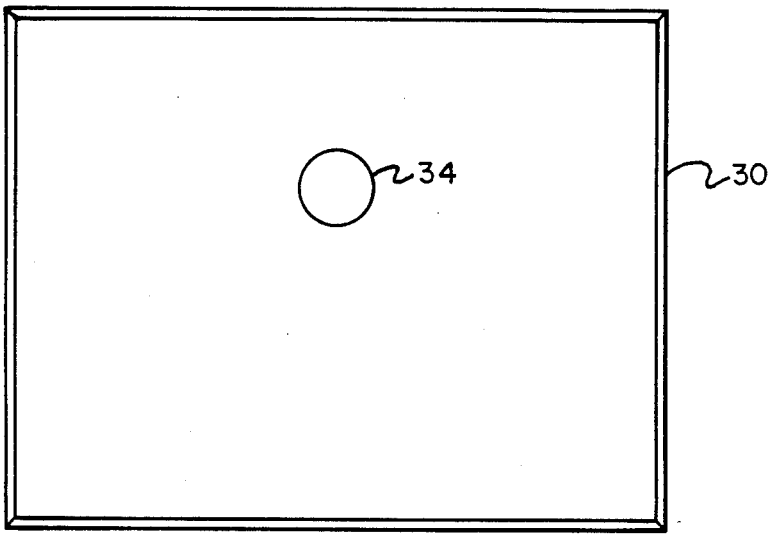
FIG. 5 is a plan view of a portion of the means for protecting the modular panel of lead shielding of FIGS. 2 and 3.
Figure 6:
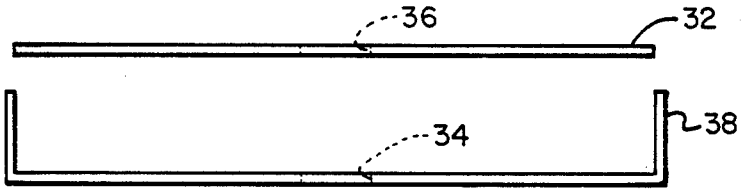
FIG. 6 is an elevational view of the sheath means of FIG. 5.
Figure 7A:
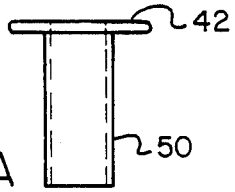
Figure 7B:
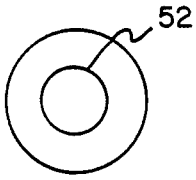

FIG. *7a* is a elevational view of a hole sheathing for use with the means for protecting of FIGS. 5 and 6;

FIG. *7b* is a plan view of a washer component for use with the sheathing component of FIG. *7a ;*

Figure 8:
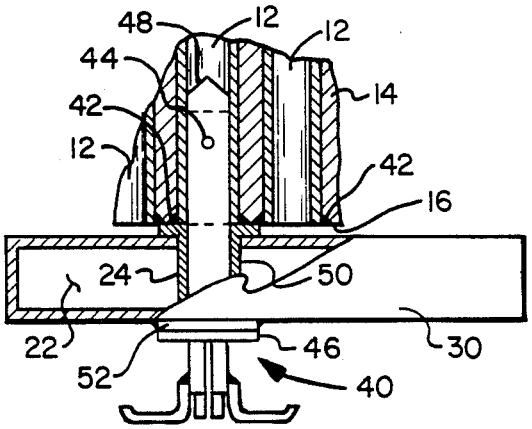

FIG. 8 is a schematic side elevational view of a modular radiation shielding panel constructed according to the invention in use on the lower side of a nuclear steam generator tubesheet to protect inspection and repair workers in the primary head of a nuclear generator from radiation of the tubesheet and the plurality of tubes it secures, with the panel secured by means extending through the transverse openings in register and aligned with a tube for releasably fastening the modular panel to the tubesheet.

DESCRIPTION OF THE DISCLOSED EMBODIMENT

Figure 1:
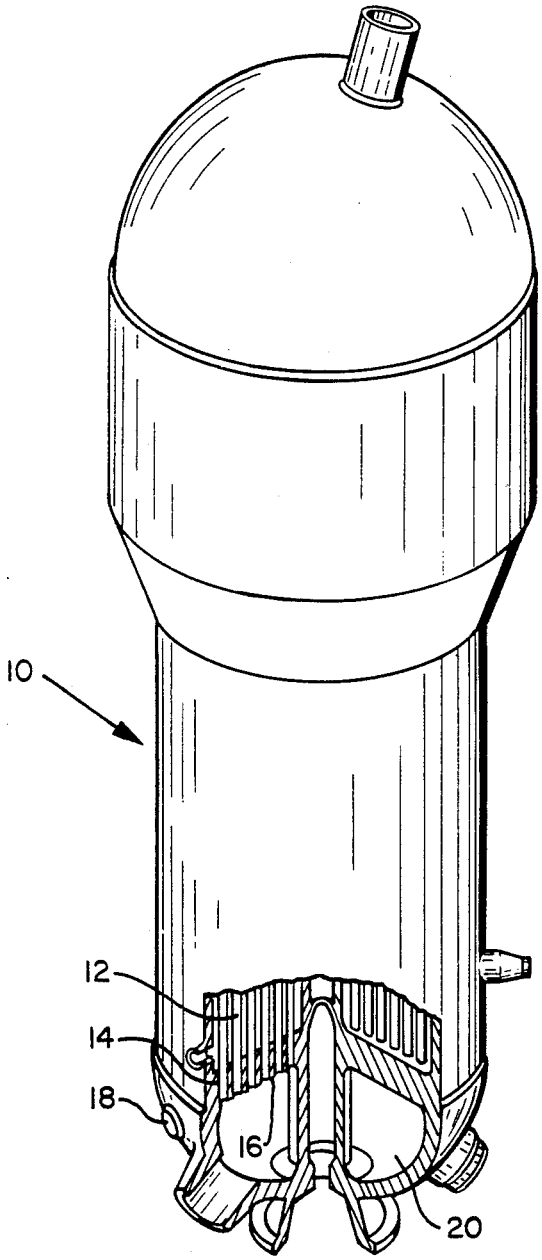
FIG. 1 is a schematic elevational view of a nuclear steam generator partially cut away to show the tubesheet and lower head region.

FIG. 1 depicts a typical steam generator 10 for a nuclear power plant. The steam generator has tubes 12 which are typically $\frac{3}{4}$ or $\frac{7}{8}$ of an inch outside diameter with a 0.05 inch wall thickness. Each of the thousands of tubes is inserted into a hole in the tubesheet face or lower surface 16. Experience has shown that the tubes 12 are prone to deterioration. Accordingly, they must be inspected and when necessary taken out of service by plugging or repaired by sleeving, through their open ends at the tubesheet face 16. Servicing personnel gain access to this space by crawling through the manway 18 and standing in the primary head 20 which may typically prove an approximate five foot clearance. Since the primary head 20 is highly radioactive, time on this task in this area is very limited but can be extended if proper radiation shielding can be provided.

Figure 2:
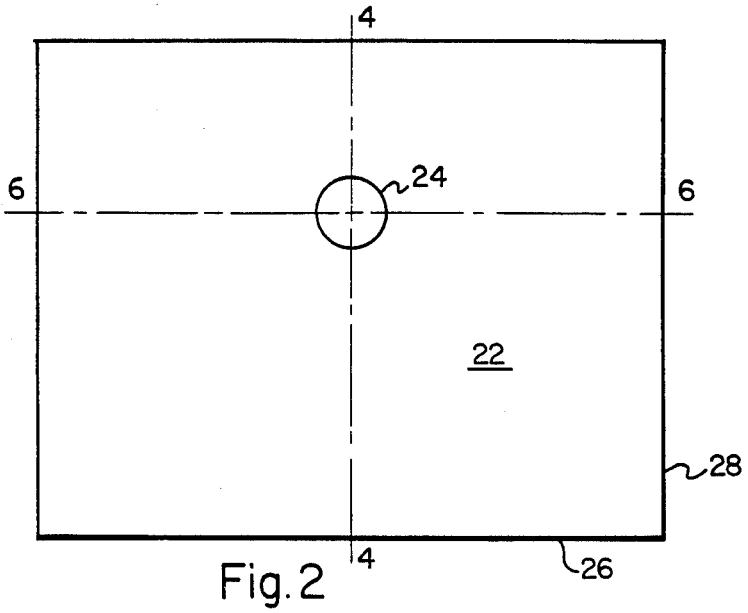
FIG. 2 is a plan view of a modular panel of lead shielding.
Figure 3:
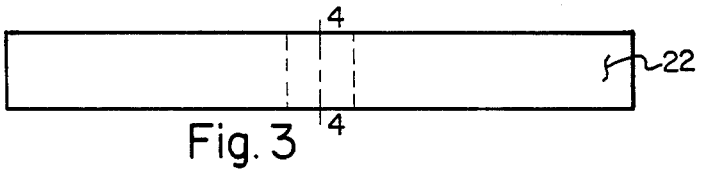
FIG. 3 is an elevational view of the panel of FIG. 2.
Figure 4:
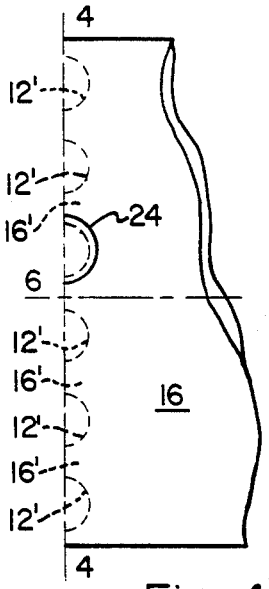
FIG. 4 is an partial schematic view taken along the axis of symmetry 4—4 of FIG. 2 indicating potential tubesheet hole locations in broken lines.

FIG. 2 shows a modular radiation shielding panel 22 for use on the lower side 16 of the nuclear steam generator tubesheet 14. The modular lead shielding panel 22 is typically of rectangular or other simple plain geometric shape for both ease of manufacture and ease of use. Although steam generator tubesheets and tubes supported thereby vary in dimension, a typical modular tile might be $8\frac{5}{8}''$ in length and $7\frac{3}{8}''$ in width. Such a lead plate conveniently is 1" thick and has a 1" diameter hole located on an axis of symmetry therewith which bisects its longest dimension. This axis is labeled 4—4 in the various figures. An asymmetric axis 6—6 perpendicular to the axis of symmetry 4—4 and also passing through the center of the transverse hole 24, may typically be located 4 5/16" from the longitudinal edge of the imaginary rectangle of lead tile 22 which makes it equidistant from both the longitudinal edge 26 and the longitudinal edge 28 of the rectangle which defines the geometric shape of the lead plate 22. The location of the hole 24 is determined by the particular size and location of tubes 12 in the tubesheet and whether they are arranged in a square pitch or a triangular pitch. In the typical pattern illustrated, for example, the 7⅜" width of the lead tile 22 will shield six openings width-wise, and with its 8⅝" of length will shield seven holes length-wise on the tubesheet 14. The position of tubes along the symmetrical axis 4—4 is schematically shown in FIG. 4 in the form of broken-line half circles 12' and they are separated by the tubesheet material 16' of tubesheet 16 lying between them. The lead tiles are arranged with the hole 24 in the location as shown such that if a previously plugged tube is encountered where the hole 24 is intended to be aligned, a quick 180° rotation permits the hole to be lined up with another tube 12.

Because of the softness of the lead and its propensity to be dented or otherwise misshapen by external forces and impacts, the lead tile 22 is provided with a means for protecting it. The means for protecting the modular panels 22 of lead sheathing, is a sheath of material such as stainless steel, which is harder than lead, and which is easily decontaminated. In FIGS. 5 and 6, a sheath is illustrated in the form of a box-like structure 30 slightly larger than the lead panel 22. For example, in the dimensions given, the sheath may have an outer dimension of 7½" width, by 8¾" length, with a hole center 34 located at the corner of a square 4⅜" from the outside edge of the sheath 30 to the center of the hole. The inside height of the sheath would be approximately ⅝". The hole 34 of the sheath 30, and 36 of the top 32, will thus be in register with a transverse hole 24 of the lead tile 22 when placed in the sheath or box 30 with the top 32 thereon welded or otherwise secured in place. To complete the sheathing, the box 30, after having the lead insert placed therein and the top 32 welded to its sides 38 is provided with a tube 50 having a washer 52 welded at either end. Tube 50 is inserted through the holes 34 and 36, and hole 24 in register therewith, thus completing the sheathed tile or modular radiation shielding panel assembly.

The modular radiation shielding system for use on the lower side of a nuclear steam generator tubesheet 14 to protect inspection and repair workers in the primary head 20 from radiation of the tubesheet 14 and tubes 12 that it secures preferably utilizes a particular fastening means 40. The fastening means 40 extends through the transverse openings 24, 34 and 36 in register, and a tube 12 aligned therewith, thereby releasably fastening the modular panel to the tube sheet face 16. The "Rapid Installation Tube Gripper" 40 can be rapidly attached inside the end of the tube 12 which is held by means of weld 42 in tubesheet 14. The tube engaging balls 44 are manipulated by means of a flange 46 secured to an internal sleeve in a manner fully disclosed in the previously referenced U.S. patent application Ser. No. 686,114 filed Dec. 24, 1984. It is sufficient for this disclosure to state that the locked and released positions of the balls 44 and tapered shaft 48 are maintained by the internal sleeve to which flange 46 is attached until the device 40 is inserted into or removed from the tube.

It will be understood by those skilled in the art that upon the installation of a plurality of the modular radiation shielding panels according to the system described herein, there will be areas within particular tubes 12 which the rapid installation tube grippers 40 are filling which will not include any shielding from radiation. This is because there will be no lead between the workers under the lead shielding panel assemblies and the inside surface of the tube. To alleviate this condition and to further insure maximum shielding, the projecting tapered end 48 of the rapid installation tube gripper 40 can be lead filled, thus creating a lead finger portion which prevents radiation from the tube 12 "to shine" into the primary head 20, to any appreciable degree, from the otherwise unshielded tube containing the gripper 40.

While the foregoing description is of a system to be installed on the lower surface of a tubesheet in a nuclear reactor steam generator, it is obvious that the invention can be used in many other applications that require lead shielding. The adaptability of the modular concept, both from a standpoint of ease of manual handling of the shielding assemblies, and from the standpoint of being able to be quickly installed and removed in various confined areas makes the modular radiation shielding system of the instant invention particularly useful whether provided in the disclosured embodiment or in equivalent structures.

We claim:

1. A modular radiation shielding system for use on the lower side of a nuclear steam generator tubesheet to protect inspection and repair workers in the primary head of the generator from radiation of the tubesheet and plurality of tubes it secures, said system comprising:

a plurality of modular panels of lead shielding of like geometric shape, each having a transverse opening for alignment with a tube and being symmetrical about one axis and asymmetrical about a second axis perpendicular thereto so that if a previously plugged tube is encountered, a quick 180° rotation aligns the transverse opening in register with another tube;

means for protecting said modular panels of lead shielding of like geometric shape from damage by external forces and from producing unwanted lead deposits in the steam generator;

said means for protecting said modular panels defining for each such panel, a sheath of material harder than lead having at least one opening transverse to the panel and in register with the transverse opening of the panel at a location at which the distance from the centers of the transverse openings in register and aligned with a tube in the tubesheet to the edge of the geometric shape places the edge in register with tubesheet material between a plurality of tubes; and, means extending through the transverse openings in register and aligned with a tube in the tubesheet for releasably fastening said modular panel to said tubesheet.

2. The system of claim 1 in which the means for releasably fastening includes wedged balls held in position by a sleeve and extends into at least one of the plurality of tubes secured by the tubesheet.

3. The system of claim 2 in which the means for releasably fastening includes a lead portion for shielding.

4. The system of claim 1 in which the transverse opening of the panel is lined by a portion of the means for protecting.

5. A modular radiation shielding panel for use on the lower side of a nuclear steam generator tubesheet to protect inspection and repair workers in the primary head of the generator from radiation of the tubesheet and plurality of tubes it secures, said panel comprising:

a geometrically shaped planar body of lead having a transverse opening for alignment with a tube in the tubesheet and being symmetrical about one axis and asymmetrical about a second axis perpendicular thereto so that if a previously plugged tube is encountered, a quick 180° rotation aligns the transverse opening in register with another tube;

means for protecting said planar body of lead from damage by external forces and from producing unwanted lead deposits in the steam generator; and said means for protecting said lead body defining a sheath of material harder than lead having at least one opening transverse to the planar body in register with the transverse opening of the planar body at a location at which the distance from the centers of the transverse openings in register and aligned with a tube in the tubesheet to the edge of the geometrically shaped planar body places the edge in register with tubesheet material between a plurality of tubes.

6. The panel of claim 5 in which the means for protecting is stainless steel.

* * * * *